US006581685B2

(12) United States Patent
Burgess et al.

(10) Patent No.: US 6,581,685 B2
(45) Date of Patent: Jun. 24, 2003

(54) METHOD FOR DETERMINING FORMATION CHARACTERISTICS IN A PERFORATED WELLBORE

(75) Inventors: Keith A. Burgess, Houston, TX (US); Peter S. Hegeman, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1 day.

(21) Appl. No.: 09/962,632

(22) Filed: Sep. 25, 2001

(65) Prior Publication Data

US 2003/0056950 A1 Mar. 27, 2003

(51) Int. Cl.[7] ..... E21B 49/00

(52) U.S. Cl. ..... 166/250.02; 166/250.16; 175/50; 73/152.05; 73/152.42

(58) Field of Search ..... 73/152.05, 152.18, 73/152.42, 152.54; 166/250.02, 250.16, 250.17; 175/50

(56) References Cited

U.S. PATENT DOCUMENTS

| | | | | |
|---|---|---|---|---|
| 2,747,401 A | | 5/1956 | Doll | |
| 3,859,851 A | | 1/1975 | Urbanosky | |
| 4,742,459 A | | 5/1988 | Lasseter | |
| 4,890,487 A | * | 1/1990 | Dussan V. et al. | 73/152 |
| 5,065,619 A | | 11/1991 | Myska | |
| 5,195,588 A | | 3/1993 | Dave | |
| 5,247,830 A | | 9/1993 | Goode | |
| 5,269,180 A | | 12/1993 | Dave et al. | |
| 5,692,565 A | | 12/1997 | MacDougall et al. | |

OTHER PUBLICATIONS

SPE 64650, Advanced Dual Probe Formation Tester with Transient, Harmonic, and Pulsed Time–Delay Ttesting Methods Determines Permeability, Skin, and Anisotropy, Proett et al, Nov. 2000.*

TW MacDougall, RW Siegfried, KA Burgess & TG Fields, "Wireline–Conveyed through–Casing Formation Tester Preserves Casing Integrity," *SPE 72371*, Eastern Regional Meeting, Canton OH, (Oct. 17–19, 2001).

D Wilkinson & PS Hammond "A Perturbation Theorem for Mixed Boundary Value Problems in Pressure Transient Testing," *Transport in Porous Media* 5, pp. 609–636 (1990).

Goode, PA & Thambynayagam, RKM "Analytic Models for a Multiple Probe Formation Tester," *SPE 20737*, 65$^{th}$ Annual Technical Conference and Exhibition, New Orleans, LA, Sep. 23–26 1990 (pp. 211–224).

Moran JH & Finklea EE "Theoretical Analysis of Pressure Phenomena Associated with the Wireline Formation Tester," *J. Pet. Tech., Aug. 1962* (pp. 899–908).

Goode, PA & Thambynayagam, RKM "Influence of an Invaded Zone on a Multiprobe Formation Tester," *SPE Formation Evaluation*, Mar. 1996 (pp. 31–40).

* cited by examiner

*Primary Examiner*—William Neuder
(74) *Attorney, Agent, or Firm*—Jennie (JL) Salazar; Brigitte L. Jeffery; John J. Ryberg

(57) ABSTRACT

A method for determining the characteristics of a subterranean formation penetrated by an existing or drilled well is disclosed. The method uses a mathematical model to estimate formation parameters as fluid exits the formation through a hole and into the wellbore or tool. The model may be adapted to wells having a perforation extending from the wellbore into the formation by mathematically adjusting the perforation to the hole of the mathematical model. The formation properties may be estimated by mathematically eliminating the perforation and replacing it with an enlarged hole radius to simulate the mathematical model.

21 Claims, 3 Drawing Sheets

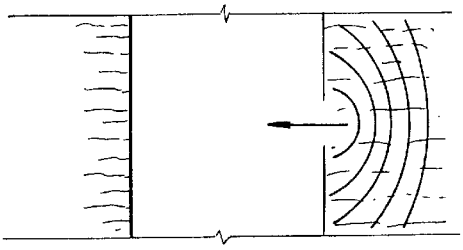
FIG. 2
FIG. 3A
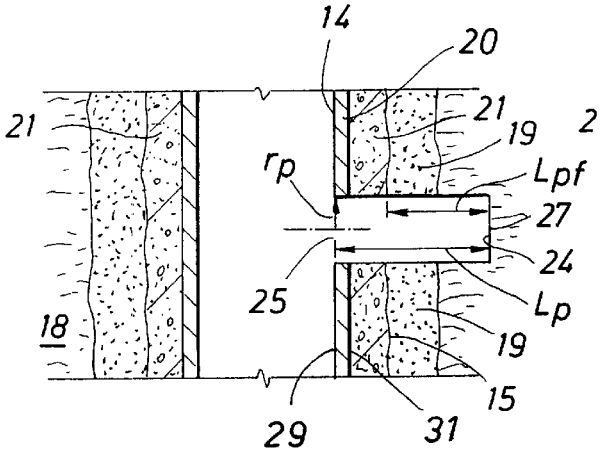
FIG. 3B
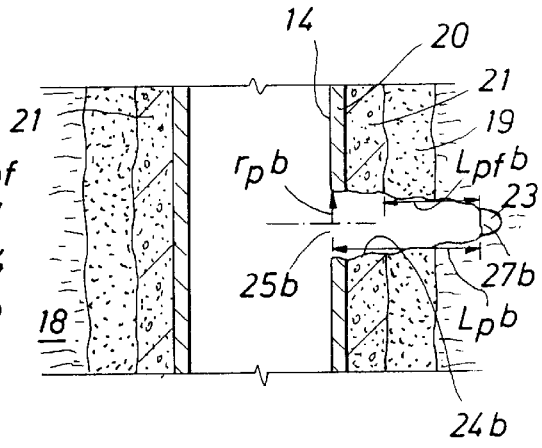
FIG. 3C
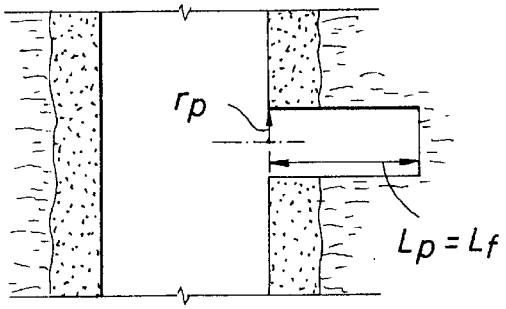
FIG. 3D
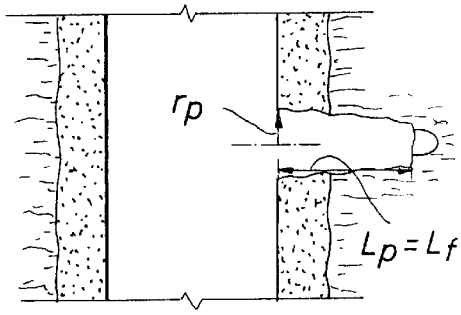

FIG. 4
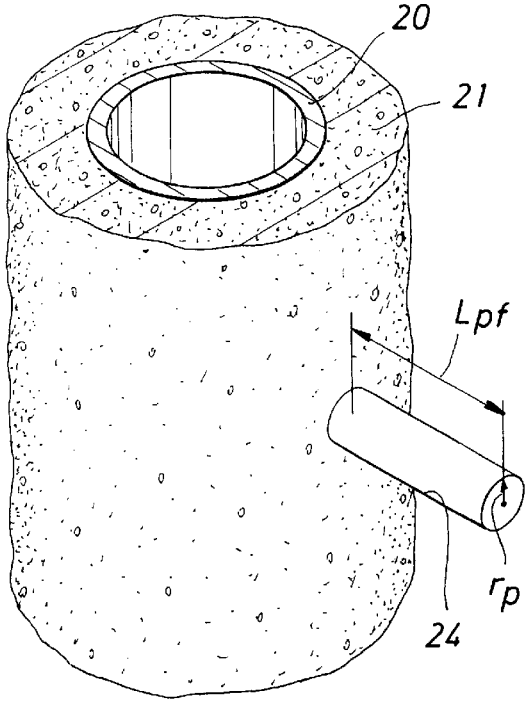
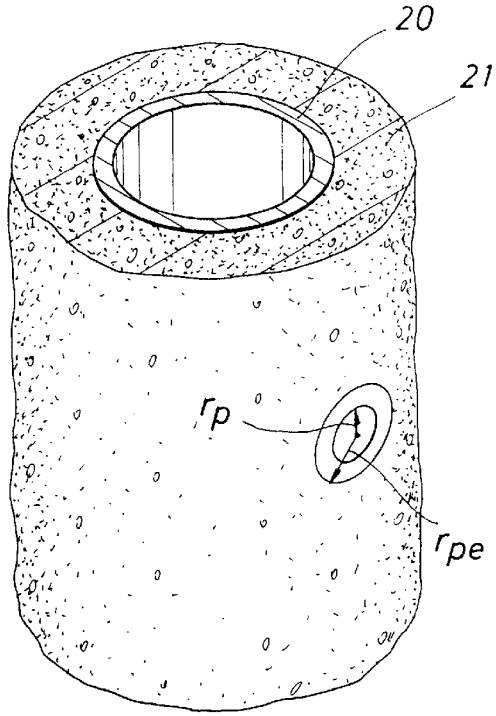
FIG. 5
FIG. 6
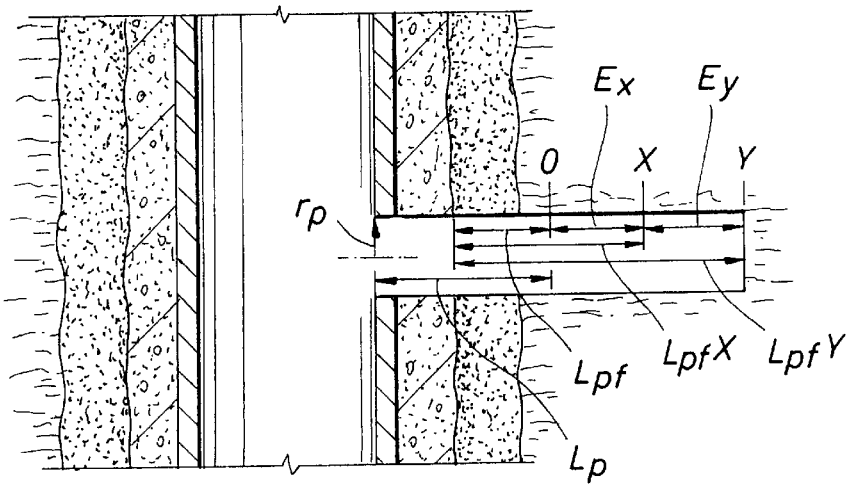

METHOD FOR DETERMINING FORMATION CHARACTERISTICS IN A PERFORATED WELLBORE

BACKGROUND OF THE INVENTION

1. Field of the Invention

This invention relates generally to the analysis of wells penetrating subterranean formations, and more particularly, the determination of subsurface formation properties such as pressure, permeability and the like in perforated wells.

2. Description of Related Art

Various fluids such as oil, water and natural gas are obtained from a subterranean geologic formation, referred to as a reservoir, by drilling a well that penetrates the fluid-bearing formation. Once a wellbore has been drilled, the well must be completed before fluids can be produced from the well. Well completion involves the design, selection, and installation of equipment and materials in or around the wellbore for conveying, pumping, and/or controlling the production or injection of fluids. After the well has been completed, production of fluids can begin.

Typically, wells are either cased or open hole wells. An open hole well is usually just a wellbore that is drilled into the ground or ocean floor. A cased well is an open hole well with a tubular steel casing inserted therein to line the sidewall of the wellbore. Cement is pumped downhole into the wellbore and forced uphole into an annulus between the casing and the sidewall of the wellbore to secure the casing in place.

It is often necessary to perforate the sidewall of the wellbore of cased or open hole wells to allow fluid to flow from the formation into the wellbore as shown in FIG. 1. Penetration may be achieved in open hole wells by punching or drilling a hole or perforation into the sidewall of the wellbore. However, in cased holes, it is necessary to puncture or drill through the casing and cement before the sidewall of the wellbore may be penetrated and the formation reached. Various techniques for penetrating the sidewall of the wellbore of cased and/or open hole wells have been heretofore developed. An example of such a technique for creating a perforation which involves extending a drill bit through the casing and into the formation using a downhole tool with a flexible drill shaft may be seen in U.S. Pat. No. 5,692,565, the entire contents of which is hereby incorporated by reference.

It is often desirable to determine various characteristics of the well and its penetrated formation. By analyzing the characteristics of the well and the formation, it is possible to obtain information that may help to determine how the well will produce. Various techniques have been developed to determine characteristics of the wellbore. For example, so called "formation testing tools" have been developed to provide logging in cased wellbores as exemplified by U.S. Pat. Nos. 5,065,619; 5,195,588; and 5,692,565, the entire contents of which are hereby incorporated by reference.

The '619 patent discloses a means that penetrates the formation for testing the pressure of a formation behind casing in a wellbore. A "backup shoe" is hydraulically extended from one side of a wireline formation tester for contacting the casing wall, and a testing probe is hydraulically extended from the other side of the tester. The probe includes a surrounding seal ring that forms a seal against the casing wall opposite the backup shoe. A small explosive shaped charge is positioned in the center of the seal ring for perforating the casing and surrounding cement layer, if present. Formation fluid flows through the perforation and seal ring into a flow line for delivery to a pressure sensor and a pair of fluid manipulating and sampling tanks.

The '588 patent improves upon the formation testers that perforate the casing to obtain access to the formation behind the casing by providing a means for plugging the casing perforation. More specifically, the '588 patent discloses a tool that is capable of plugging a perforation while the tool is still set at the position at which the perforation was made. Timely closing of the perforations(s) by plugging prevents the possibility of substantial loss of wellbore fluid into the formation and/or degradation of the formation. It also prevents the uncontrolled entry of formation fluids into the wellbore, which can be deleterious such as in the case of gas intrusion.

The '565 patent describes a further improved apparatus and method for testing a formation behind a cased wellbore, in that the invention uses a flexible drilling shaft to create a more uniform casing perforation than with a shaped charge. The uniform perforation provides greater reliability that the casing will be properly plugged, because the explosive shaped charges result in non-uniform perforations that can be difficult to plug. Thus, the uniform perforation provided by the flexible drilling shaft increases the reliability of using plugs to seal the casing. The drilling shaft can also be used to test the formation at differing distances from the wellbore. By testing the pressure transient characteristics of the perforation at varying distances from the wellbore, a more precise model of the near wellbore formation damage can be obtained.

While various tools have been developed to test formations, there remains a need for estimating the reservoir characteristics based on the known parameters and/or measured data. Models and other conventional formation tester analysis techniques have been developed to estimate the properties of the formation. One such mathematical model, depicted in FIG. 2, has been used to determine various formations parameters as set forth in the publication entitled "Analytical Models for Multiple Formation Tester" by P. A. Goode and R. K. M. Thambynayagam, *SPE Formation Evaluation,* December 1992, p. 297–303 ("SPE 20737") the entirety of which is hereby incorporated by reference. The analytical model of SPE 20737 uses the pressure transient response to determine the pressure and permeability of the subterranean formation.

Data collected by the tool, as fluid flows from the formation, may be used to determine formation characteristics based on a mathematical model. The mathematical model set forth in the SPE paper 20737 may be used to determine various formation properties from the pressure and fluid data collected. According to SPE 20737, formation properties, such as pressure and permeability may be estimated using the mathematical model. The model of FIG. 2 assumes that the formation fluid is permitted to exit the formation through the hole and enter a wellbore or a tool. Fluid flow patterns are generally spherical as they approach a hole, and became generally radial further away from the hole. Notably absent from the mathematical model depicted in FIG. 2 is the perforation extending into the formation.

Another mathematical model used to determine various formations parameters is "A Perturbation Theorem for Mixed Boundary Value Problems in Pressure Transient Testing" by D. Wilkinson and P. Hammond (*Transport in Porous Media* (1990) 5, 609–636), the entire contents of which is hereby incorporated by reference. The analytical model of the paper by Wilkinson and Hammond uses the pressure transient response during the drawdown period of a pressure test to determine the mobility of the formation and fluid. However, both of the models fail to take into consideration the effect of perforations extending into the wellbore when determining formation parameters.

The present invention overcomes the inadequacies of the previous methods by providing a method for determining various formation parameters while taking into consideration the alteration in the fluid characteristics resulting from the perforation.

SUMMARY OF THE INVENTION

The present invention relates to a method for determining the characteristics of a formation penetrated by a wellbore. The method involves creating a perforation having a hole radius and a length in the formation. An equivalent probe radius value is calculated for the perforation based upon the hole radius and length. Formation analysis calculations may then be performed using the equivalent probe radius in lieu of the hole radius.

The present invention also relates to a method for calculating formation properties in a subterranean formation penetrated by a wellbore, the wellbore having a perforation extending into the subterranean formation. The method relates to determining a radial hole radius and length of the perforation, calculating an equivalent probe radius for the perforation, and using the equivalent probe radius as the radial hole radius in formation analysis calculations.

A method of formation analysis for a formation penetrated by a wellbore is also disclosed. The method involves creating a cylindrical hole extending from the wellbore, the cylindrical hole having a known radius and first length, calculating an equivalent probe radius based upon the hole radius and first length, conducting formation analysis tests, and adjusting the model utilizing the equivalent probe radius in place of the hole radius, thereby calculating initial wellbore formation properties. The cylindrical hole is then extended further into the formation, thereby creating a second length. The equivalent probe radius may then be determined for the second length thereby calculating extended wellbore formation properties.

Another aspect of the invention relates to a method of generating a reservoir property profile around a wellbore. The method relates to sequentially extending a perforation to differing distances from the wellbore into the formation, calculating an equivalent probe radius ($r_{pe}$) for each different perforation length based upon the perforation radius ($r_p$) and the formation length ($L_{pf}$) in the formation using the following formula:

$$r_{pe}=\mathrm{SQRT}[r_p*(r_p+2*L_{pf})],$$

conducting reservoir analysis tests at each different perforation length, performing reservoir analysis calculations using the equivalent probe radius in place of the perforation radius to determine reservoir properties at each of the different perforation lengths, comparing the reservoir properties for each of the perforation lengths, and generating a reservoir property profile at various distances from the wellbore.

The present invention also relates to a method of adapting conventional formation analysis techniques. The method relates to providing a perforation into the formation, the perforation having a radius and a length, calculating an equivalent probe radius for the perforation, based upon the perforation radius and formation length and an equivalent probe radius formula, and performing conventional formation analysis calculations utilizing the equivalent probe radius in lieu of the perforation radius value.

BRIEF DESCRIPTION OF THE DRAWINGS

The invention may be understood by reference to the following description taken in conjunction with the accompanying drawings, in which like reference numerals identify like elements, and in which:

FIG. 2 is a schematic of a model of a subterranean formation penetrated by a wellbore depicting the flow of fluid from the formation into the wellbore through a hole;

FIG. 3A is a section of the wellbore of FIG. 1 having a drilled perforation proceeding therefrom;

FIG. 3B is a section of the wellbore of FIG. 1 having a shaped charge perforation proceeding therefrom;

FIG. 3C is a schematic diagram of a section of an openhole wellbore having a drilled perforation proceeding therefrom;

FIG. 3D is a schematic diagram of a section of an openhole wellbore having a shaped charge perforation proceeding therefrom;

FIG. 4 is a three-dimensional representation of the wellbore section of FIG. 3A having a drilled perforation proceeding therefrom;

FIG. 5 is the three-dimensional wellbore section of FIG. 3A adjusted to an equivalent probe radius; and FIG. 6 is the schematic section of FIG. 3A with the drilled perforation extended further into the formation.

Figure 1:
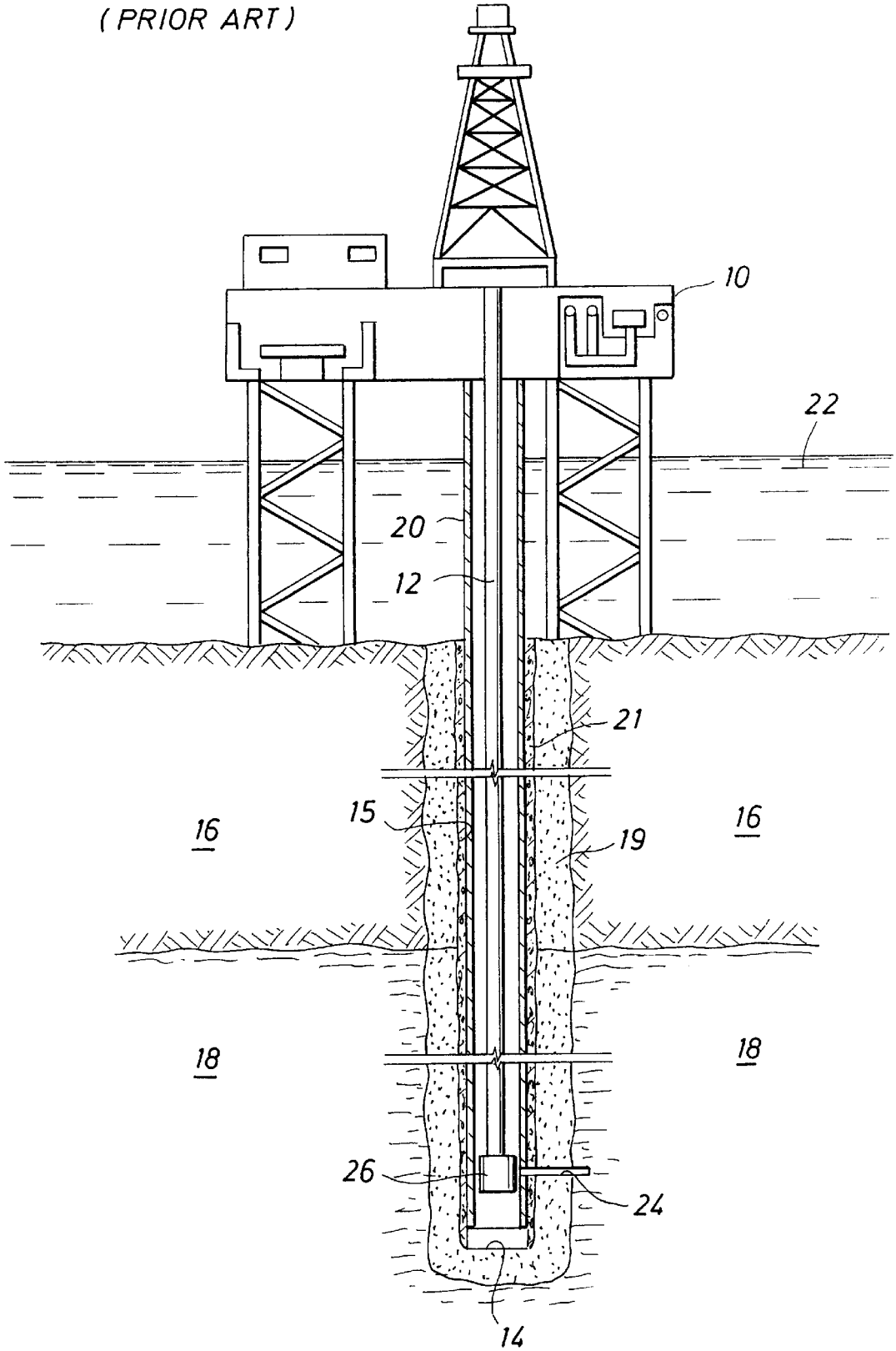
FIG. 1 (PRIOR ART)
FIG. 1 is a schematic diagram of a cased wellbore extending from a drilling/production platform into subterranean formations.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the scope of the invention as defined by the appended claims.

DESCRIPTION OF ILLUSTRATIVE EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

As used herein, the terms "up" and "down"; "upper" and "lower"; "upwardly" and "downwardly"; and other like terms indicating relative positions above or below a given point or element and are used in this application to more clearly describe some embodiments of the invention. However, when applied to equipment and methods for use in wells that are deviated or horizontal, such terms may refer to positions within the horizontal plane in reference to a tool string or fluid flowpath, or other relationship as appropriate, rather than the vertical plane.

Referring to the attached drawings, FIG. 1 illustrates a representative prior art drilling/production platform 10 having a tubular string 12 extending into a wellbore 14 having a sidewall 15. The wellbore 14 penetrates subterranean formations 16, and intersects a productive reservoir 18. A damaged zone 19 extends around the borehole adjacent the subterranean formation 16 and the productive reservoir 18.

A casing 20 lines the well and provides support and isolation of the wellbore 14 from the reservoir 18, other formations 16 and bodies of water 22. A drilled perforation 24 is drilled through the casing string 20 and into the productive reservoir 18 using a formation testing tool 26. The formation testing tool 26 is capable of taking measurements, such as pressure and flow data, from the produced fluids flowing into the drilled perforation 24. The well may have multiple production zones, may comprise a horizontal or multilateral well, or comprise any other type of completion used in a subterranean wellbore. A vertical well having a single production zone is shown for ease of description only.

Formation testers, such as the formation testing tool 26 of FIG. 1, may be provided to take downhole measurements. While FIG. 1 depicts a tubular string perforating a cased hole, it will be appreciated that various tools may be used to penetrate the sidewall of the borehole of a cased or open hole well and/or take downhole measurements. Open-hole and cased-hole formation testers, drilling tools and wireline borehole samplers have long been used in the oil industry to acquire a host of measurements including pressure, temperature, formation fluid type, fluid resistivity and dielectric characteristics. The measurements from these formation testers may be used to determine formation and fluid properties, such as formation pressure, permeability, damaged zone permeability, relative permeability, capillary pressure, rock compressibility, fluid saturations, fluid type, fluid density and the like.

Referring now to FIG. 3A is a portion of the wellbore 14 of FIG. 1. The casing 20 is surrounded by cement 21 which, in turn, lines the sidewall 15 of the wellbore 14. The perforation 24 extends from the wellbore 14 through the casing 20, the cement 21, the damaged zone 19 and into the reservoir 18.

The perforation 24 depicted in FIG. 3A represents a perforation created using a drilling tool with a flexible shaft, such as the tool depicted in U.S. Pat. No. 5,692,565 previously incorporated herein by reference. The perforation 24 is a generally cylindrical hole having an opening 25 at the casing 20 and an end 27 at the reservoir 18. The perforation 24 is created by extending a drill bit through the casing, the cement, the damaged zone and into the formation. The radius $r_p$ of the perforation 24 relates to the radius of the drill bit or probe extending through the casing and into the reservoir to form the perforation 24.

The length of the perforation 24 is a generally known distance $L_p$ ("perforation length") which may be determined based on the length of the drill bit, or by using sensors. The perforation length $L_p$ extends from the internal wall 29 of the casing 20 to the end 27 of the drilled perforation 24. A second length $L_{pf}$ ("formation length") represents the portion of the perforation 24 extending from the outer wall 31 of the cement 21 to the end 27 of the perforation 24. Formation length $L_{pf}$ may be determined by subtracting the known thickness of the casing and the cement (or thickness determined by sensors) from the perforation length $L_p$.

FIG. 3B shows a shaped charged perforation 24*b* in the wellbore 14 of FIG. 3A. The perforation 24*b* extends from the wellbore 14 through the casing 20, the cement 21, the damaged zone 19 and into the reservoir 18. The perforation 24*b* is a generally frusto-conical hole having an opening 25*b* at the casing 20 and an end 27*b* at the shaped charge 23. The opening 25*b* of the perforation 24*b* has jagged edges resulting from the force of the shaped charge as it punctures the casing and pushes into the formation. Unlike the perforation 24 of FIG. 3A, the perforation 24*b* of FIG. 3B is rougher and tapers as it approaches the reservoir 18.

The perforation 24*b* depicted in FIG. 3B represents a perforation created using a puncture tool which fires a shaped charge 23 into the formation, such as the tool depicted in U.S. Pat. Nos. 5,065,619 and 5,195,588 previously incorporated by reference herein. The perforation 24*b* is created by firing the shaped charge 23 through the casing, the cement, the damaged zone and into the reservoir. The radius $r_p$b of the perforation 24*b* relates to the radius of the hole created by the shaped charge.

The perforation length $L_p$b of the perforation 24*b* may be determined by estimating the distance of travel of the shaped charge. The perforation length $L_p$b extends from the internal wall 29 of the casing 20 to the end 27*b* of the shaped charge 23. A formation length $L_{pf}$b represents the portion of the perforation 24*b* extending from the cement 21 to the end 27*b* of the perforation 24*b*. Formation length $L_{pf}$b may be determined by subtracting the known thickness of the casing and the cement from the perforation length $L_p$b.

While FIGS. 3A and B depict the perforations created by drilling and puncturing techniques, it will be appreciated that other drilling and puncturing techniques may be used to form perforations of various geometries other than the cylindrical and frusto-conical shapes depicted herein. It will also be appreciated that while FIGS. 1, 3A and 3B depict cased holes, perforations may also be punctured or drilled into open hole wells as shown in drilled perforation of the open wellbore of FIG. 3C and the punctured perforation of the open wellbore of FIG. 3D. The shape of the perforated hole may also vary.

FIG. 4 shows another view of the cased wellbore 14 of FIG. 3A with a drilled perforation 24. The perforation 24 is a generally cylindrical channel extending a distance beyond the cement 21 of the wellbore 14. The fluid flow characteristics are altered by the presence of the drilled perforation 24. As a result, the mathematical model of FIG. 2 may be adjusted to account for the effects of the perforation. By taking into account the geometry of the perforated hole, it is possible to adjust the model to match the flow characteristics due to the presence of the perforated hole.

When predicting formation characteristics, it is desirable to use measurements from a drilled perforation due to the symmetry of the perforation and its more predicable geometry. With drilled perforations, it is possible to determine and control the length of the drilled perforation. The drilled perforation may enable the testing of the formation at various lengths, thereby providing information along the profile of the drilled perforation at different distances from the wellbore. This information can provide a modeling of the formation while taking into consideration the geometry of the perforation and its effect on the formation.

The geometry of the perforation of FIG. 4 may be mathematically adjusted to simulate the model of FIG. 2. Essentially, the perforated hole as shown in FIG. 4 is translated into an enlarged hole in the wellbore of the simulated model as shown in FIG. 5. This is accomplished by replacing the geometry of the perforated hole having a formation length $L_{pf}$ and a radius $r_p$ with an enlarged equivalent probe radius $r_{pe}$ using the following calculation:

$$r_{pe}*r_{pe}=r_p*(r_p+2*L_{pf})$$

Solving this equation for the equivalent probe radius results in the following:

$$r_{pe}=\mathrm{SQRT}[r_p*(r_p+2*L_{pf})]$$

where SQRT represents the square root of the bracketed terms.

Once the equivalent radius is determined, conventional formation tester analysis techniques can then be used to estimate formation properties such as permeability, formation pressure and near wellbore damage. The equivalent probe radius method will benefit the estimation of mobility and flow rate versus time response during sampling, and rock property determination during stress testing with cased-hole formation drilling and testing tools.

Referring now to FIG. 6, the perforation 24 of the wellbore 14 is shown extended further into reservoir 18 following a series of drilling operations. Pressure drawdowns and buildup tests that may be conducted at different stages of drilling a hole through the casing, cement, damaged zone and into the formation.

Referring still to FIG. 6, the original perforation 24 has the same radius $r_p$, perforation length $L_p$ and formation length $L_{pf}$ as depicted in FIG. 3A. During an initial drilling operation, the original perforation 24 terminates at a point O. However, the perforation 24 may be extended a distance $E_x$ further into the reservoir during a subsequent drilling operation which terminates at point X. The original perforation length $L_p$ and formation length $L_{pf}$ are extended the distance $E_x$ resulting in a new formation length $L_{pf}x$ in the reservoir.

The perforation 24 may again be extended a distance $E_y$ beyond point X and terminated at point Y. The original perforation length $L_p$ and formation length $L_{pf}$ are extended a distance Ex plus Ey resulting in new formation length $L_{pf}y$. The drilling operation may be repeated as desired to extend the perforation further into the reservoir.

Referring still to FIG. 6, a first equivalent probe radius may be calculated from the known radius $r_p$ and formation length $L_{pf}$ of the drilled perforation. The equivalent radius may then be used to simulate the model and determine various formation characteristics as described previously. The drilled perforation may then be extended to a new perforation length $L_px$ past the damaged zone 30 and into a transition zone 32 of the reservoir 18. A second equivalent probe radius $r_{pe}x$ is calculated from the known radius $r_p$ and new formation length $L_{pf}x$ of the extended drilled perforation. The model may be used again to determine the formation characteristics based on the second equivalent probe radius.

The drilled perforation can then be extended again to perforation length $L_py$ past the transition zone 32 and into the undamaged productive formation 18. A third equivalent probe radius is calculated from the known radius $r_p$ and formation length $L_{pf}y$ of the extended drilled perforation. The model may be used again to determine the formation characteristics based on the third equivalent probe radius. The operation and related calculations may be repeated as many times as desired. The ability to test the well characteristics at varying distances from the wellbore can provide valuable information regarding the extent of formation damage in the near wellbore formation, the type of well treatment needed, and an improved wellbore modeling of the wells true productive capacity.

The particular embodiments disclosed herein are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope of the invention. Accordingly, the protection sought herein is as set forth in the claims below.

What is claimed is:

1. A method of determining the characteristics of a formation penetrated by a wellbore, comprising:

creating a perforation in a sidewall of the wellbore, the perforation having a hole radius and a length;

calculating an equivalent probe radius for the perforation based upon the hole radius and length; and performing formation analysis calculations using the equivalent probe radius.

2. The method of claim 1, wherein the step of calculating comprises calculating an equivalent probe radius using the hole radius and the hole length, based upon the following equivalent probe radius formula:

$$r_{pc}=\mathrm{SQRT}[r_p*(r_p+2*L_{pf})]$$

where $r_{pc}$ is the equivalent probe radius, $r_p$ is the hole radius, and $L_{pf}$ is the hole length.

3. The method of claim 1, wherein the step of performing formation analysis calculations comprises performing pressure transient calculations.

4. The method of claim 1, wherein the step of performing formation analysis calculations comprises performing fluid flowrate calculations.

5. The method of claim 1, wherein the step of performing formation analysis calculations comprises performing fluid flowrate and pressure transient calculations.

6. The method of claim 1 further comprising extending the perforation further into the formation.

7. The method of claim 6, wherein the length is extended by a distance $E_x$, and wherein the step of calculating comprises calculating an extended equivalent probe radius using the hole radius, and the hole length, based upon the following equivalent probe radius formula:

$$r_{pc}x=\mathrm{SQRT}[(r_p*(r_p+2*L_{pf}x)]$$

where $r_{pc}x$ is the extended equivalent probe radius, $r_p$ is the hole radius, and $L_{pf}x$ is the extended length.

8. The method of claim 1 further comprising conducting formation testing through the perforation.

9. The method of claim 1 further comprising extending the length of the perforation further into the subterranean formation.

10. The method of claim 9 further comprising re-calculating the equivalent probe radius using the extended length.

11. A method for determining formation properties in a subterranean formation penetrated by a wellbore, the wellbore having a perforation extending into the subterranean formation, comprising:

determining a radial hole radius and length of the perforation;

calculating an equivalent probe radius for the perforation; and using the equivalent probe radius as the radial hole radius in formation analysis calculations.

12. The method of claim 11, wherein the equivalent probe radius is calculated from the radial hole radius and length.

13. The method of claim 11, further comprising:

drilling the perforation into the subterranean formation.

14. The method of claim 11, further comprising:

conducting formation testing through the perforation.

15. The method of claim 14, wherein formation testing comprises taking one of pressure readings, fluid flow readings and combinations thereof.

16. The method of claim 1 further comprising extending the perforation further into the formation, the perforation having an extended length.

17. The method of claim 16, further comprising re-calculating the equivalent probe radius for the perforation, based on the perforation radius and the extended length.

18. A method of formation analysis for a formation penetrated by a wellbore, comprising:

a) creating a cylindrical hole extending through the sidewall of the wellbore, the cylindrical hole having a known radius and first length;

b) calculating an equivalent probe radius based upon the hole radius and first length;

c) conducting formation analysis tests;

d) performing formation analysis calculations utilizing the equivalent probe radius in place of the hole radius, thereby calculating initial wellbore formation properties;

e) extending the cylindrical hole further into the formation, thereby creating a second length; and f) repeating steps b) through d) using the second length thereby calculating extended wellbore formation properties.

19. The method of claim 18, further comprising:

comparing the initial wellbore formation properties with the extended wellbore formation properties; and generating a formation property profile with the initial wellbore and extended wellbore formation properties.

20. A method of generating a reservoir property profile around a wellbore, comprising:

sequentially extending a perforation to differing distances from the wellbore into the formation;

calculating an equivalent probe radius ($r_{pe}$) for each different perforation length based upon the perforation radius ($r_p$) and the formation length ($L_{pf}$) in the formation using the following formula:

$$r_{pe}=\mathrm{SQRT}[r_p*(r_p+2*L_{pf})];$$

conducting reservoir analysis tests at each different perforation length;

performing reservoir analysis calculations using the equivalent probe radius in place of the perforation radius to determine reservoir properties at each of the different length perforations;

comparing the reservoir properties for each of the perforation lengths; and generating a reservoir property profile at various distances from the wellbore.

21. A method of analyzing a formation penetrated by a wellbore, comprising:

providing a perforation extending from the wellbore into the formation, the perforation having a hole radius and a hole length;

calculating an equivalent probe radius for the perforation, based upon the hole radius and length and an equivalent probe radius formula; and performing conventional formation analysis calculations utilizing the equivalent probe radius in lieu of the hole radius.

* * * * *